US005358922A

United States Patent [19]

Nakayama et al.

[11] Patent Number: 5,358,922

[45] Date of Patent: Oct. 25, 1994

[54] THERMAL TRANSFER IMAGE RECORDING MATERIAL AND IMAGE USING METAL ION PROVIDING COMPOUND

[75] Inventors: Noritaka Nakayama; Katsunori Kato; Tatsuo Tanaka; Yoriko Nakayama; Tawara Komamura, all of Hino, Japan

[73] Assignee: Konica Corporation, Tokyo, Japan

[21] Appl. No.: 77,013

[22] Filed: Jun. 14, 1993

[30] Foreign Application Priority Data

Jul. 16, 1992 [JP] Japan ..... 4-189575
Sep. 7, 1992 [JP] Japan ..... 4-238298

[51] Int. Cl.[5] ..... B41M 5/035; B41M 5/38

[52] U.S. Cl. ..... 503/227; 428/195; 428/341; 428/500; 428/913; 428/914

[58] Field of Search ..... 8/471; 428/195, 913, 428/914, 340, 341, 500; 503/227

[56] References Cited

U.S. PATENT DOCUMENTS 5,180,705 1/1993 Smith et al. ..... 503/227
5,212,146 5/1993 Komamura et al. ..... 503/227
5,246,910 9/1993 Koshizuka et al. ..... 503/227

FOREIGN PATENT DOCUMENTS 78893 5/1984 Japan ..... B41M 5/26
2398 1/1985 Japan ..... B41M 5/26
197088 8/1991 Japan ..... P41M 5/38

*Primary Examiner*—B. Hamilton Hess
*Attorney, Agent, or Firm*—Jordan B. Bierman

[57] ABSTRACT

A thermal transfer recording material comprises a support and provided thereon, a layer containing a binder and a metal ion providing compound represented by the following Formula ( I ):

$$M^{2+}(X^{-})_2 \qquad \text{Formula (I)}$$

wherein $M^{2+}$ represents a divalent transition metal ion; and X represents a ligand capable of combining with the metal ion to form a complex, said ligand being represented by the following Formula (II):

Formula (II)

8 Claims, No Drawings

THERMAL TRANSFER IMAGE RECORDING MATERIAL AND IMAGE USING METAL ION PROVIDING COMPOUND

FIELD OF THE INVENTION

The present invention relates to a thermal transfer image recording material using a metal ion providing compound and an image forming method which utilizes the recording material.

BACKGROUND OF THE INVENTION

As means to form color images by transferring dyes to an image receiving element with the aid of heat, there are known a means to use a diffusion transfer heat-developable light-sensitive material and a means to use a thermal transfer material. Since these methods comprise transfer of dyes by heat energy, higher sensitivities (shortening of the transferring time) can be obtained by use of dyes which are highly diffusible on heating.

However, such highly diffusible dyes have disadvantages that transferred images are lowered in density during preservation due to rediffusion of the dyes, and that blurs are liable to occur owing to poor fixing capabilities of the dyes.

As preventive measures against such troubles, there have so far been proposed various methods for enhancing the fixation such as a method of adding mordants for the dyes to the image receiving element and a method of reacting the image receiving element with the dyes. As one of such proposals, Japanese Pat. O.P.I. Pub. Nos. 78893/1984 and 2398/1985 disclose a method for forming a chelated dye image by heating a thermal transfer material containing a heat-diffusible dye capable of forming a chelated dye to transfer the dye to an image receiving element and, thereby, allowing the dye to react with a metal ion providing compound contained in the image receiving element. Further, Japanese Pat. O.P.I. Pub. No. 197088/1991 discloses a metal ion providing compound improved in solubility, but the reactivity of forming a chelated dye is not satisfactory.

These methods are effective in preventing the lowering of dye image density and in improving the dye fixation, but have a disadvantage that a metal ion providing material can hardly be dispersed stably in an image receiving element. Particularly, when a metal ion providing compound is added to a hydrophilic binder, a preferred binder, to receive a thermal diffusible dye, the compound tends to deposit or aggregate and, thereby, causes uneven image densities which deteriorate the image quality. Further, since the metal ion providing compound itself is colored, the white background of an image gets colored, impairing the image quality. Moreover, when the chelation between metal ions and dyes is insufficient, the color tone of the dye is apt to be changed by the degree of chelation and, thereby, undesirable results are brought about in color reproduction. Accordingly, a high temperature or prolonged heating of transferred images becomes necessary to complete the chelation. And this involves another problem of making image forming apparatus complicated and expensive.

SUMMARY OF THE INVENTION

The present invention is accomplished with the aim of solving these problems.

Accordingly, a first object of the invention is to provide an image recording material capable of maintaining a metal ion providing compound in a binder in a stable dispersing state.

A second object of the invention is to provide an image recording material less in staining in white backgrounds and capable of performing chelation rapidly and an image forming method which comprises using the image recording material.

A third object of the invention is to provide a thermal transfer recording material capable of forming a color image having high density and excellent gradation on an image receiving material, especially on an image receiving material having no image receiving layer like plain paper, and an image forming method which uses the recording material.

DETAILED DESCRIPTION OF THE INVENTION

The above objects of the invention are attained by (1) a thermal transfer image recording material comprising a support and provided thereon, a layer containing a metal ion providing compound represented by the following Formula (I)

$$M^{2+}(X^-)_2 \qquad \text{Formula (I)}$$

wherein $M^{2+}$ represents a divalent transition metal ion; and X represents a ligand capable of combining with the metal ion to form a complex, said ligand being represented by the following Formula (II):

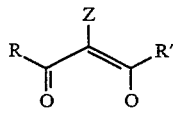

Formula (II)

wherein Z represents an alkyl group, an aryl group, an aryloxycarbonyl group, an alkoxycarbonyl group, an acyl group, a halogen atom, or a hydrogen atom; and R and R′ independently represent an alkyl group or an aryl group, provided that when Z represents a hydrogen atom, R and R′ are not simultaneously methyl groups, or at least one of R and R′ may combine with Z to form a ring. and (2) an image forming method for forming images, which comprise a chelated dye formed by reaction of the metal ion providing compound represented by the foregoing Formula (I) with a dye capable of being chelated, by applying heat according to image information in the presence of the metal ion providing compound.

The invention is hereunder described in detail.

In the compound represented by Formula (I) (hereinafter referred to as the compound of the invention), $M^{2+}$ represents a divalent transition metal ion, and a preferred example thereof includes a nickel ion or a zinc ion, since the color of the metal ion providing compound itself and the color tone of a chelated dye formed are favorable. X represents a ligand represented by the foregoing Formula (II) which can form a complex in conjunction with the divalent metal ion. Further, the compound of the invention may have a neutral ligand depending upon the type of the central metal, and typical examples of such a ligand include $H_2O$ and $NH_3$.

In the compound represented by Formula (II), Z represents an alkyl, aryl, aryloxycarbonyl, alkoxy or alkoxycarbonyl group, or a halogen or hydrogen atom. Among them, electron attractive groups, such as an aryloxycarbonyl group, an alkoxycarbonyl group and a halogen atom, are preferred since they can stabilize the metal ion providing compounds; further, an aryloxycarbonyl and alkoxycarbonyl group are especially preferred in respect of solubility. Typical examples of the aryloxycarbonyl group include a phenoxycarbonyl group. Typical examples of the alkoxycarbonyl group include linear or branched alkoxycarbonyl groups having 1 to 20 carbon atoms such as a methoxycarbonyl, ethoxycarbonyl, pentyloxycarbonyl and 2-ethylhexyloxycarbonyl group, these alkoxycarbonyl groups may be substituted with a halogen atom or an aryl or alkoxy group.

R and R′ each represent an alkyl or aryl group and may be the same or different, or R and Z, or R′ and Z, may be linked with each other to form a ring, provided that R and R′ are not simultaneously methyl groups when Z is a hydrogen atom. Examples of the alkyl group represented by Z, R or R′ include linear and branched alkyl groups having 1 to 20 carbon atoms, such as a methyl, ethyl, propyl, isopropyl, butyl, sec-butyl, t-butyl, hexyl, octyl and 2-ethylhexyl group. These alkyl groups may have a substituent such as a halogen atom or an aryl or alkoxy group. Examples of the aryl group represented by Z, R, or R′, which may have a substituent, include a phenyl and naphthyl group. Examples of the alkoxy group represented by Z include linear and branched alkoxy groups of 1 to 20 carbon atoms such as a methoxy, ethoxy and butoxy group. A preferred example of the halogen atom represented by Z is a chlorine atom.

The content of the compound of the invention is usually 0.5 to 20 g and preferably 1 to 15 g per square meter of the support.

The following are examples of the compound of the invention, but the scope of the invention is not limited to these examples.

| No | M | X |
|---|---|---|
| 1 | Ni | 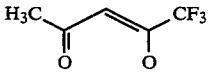 |
| 2 | Ni | 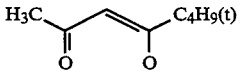 |
| 3 | Ni | 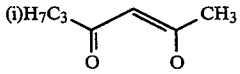 |
| 4 | Ni | 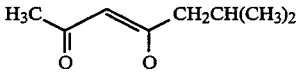 |
| 5 | Ni | 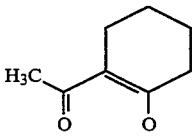 |
| 6 | Ni | 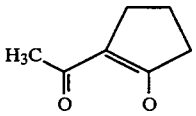 |

-continued

| No | M | X |
|---|---|---|
| 7 | Ni | 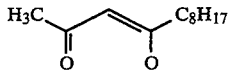 |
| 8 | Ni | 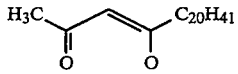 |
| 9 | Ni | 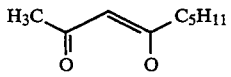 |
| 10 | Ni | 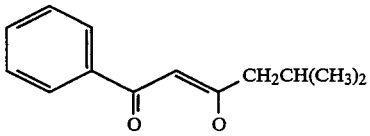 |
| 11 | Ni | 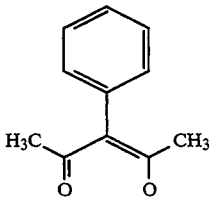 |
| 12 | Ni | 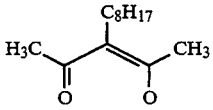 |
| 13 | Ni | 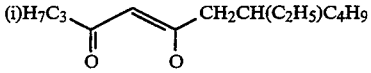 |
| 14 | Ni | 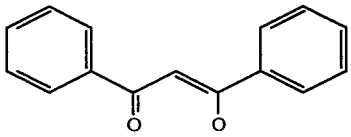 |
| 15 | Ni | 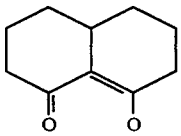 |
| 16 | Ni | 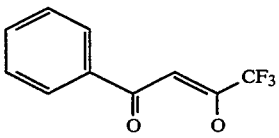 |
| 17 | Ni | 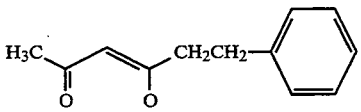 |
| 18 | Ni | 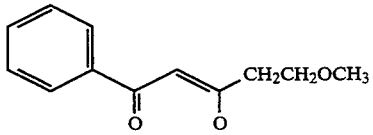 |

-continued
| No | M | X |
|---|---|---|
| 19 | Ni | 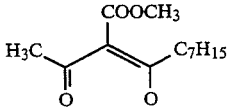 |
| 20 | Ni | 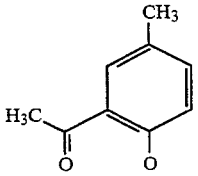 |
| 21 | Ni | 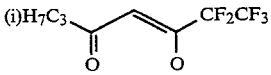 |
| 22 | Ni | 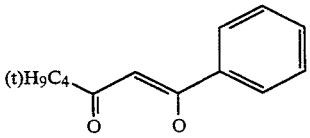 |
| 23 | Zn | 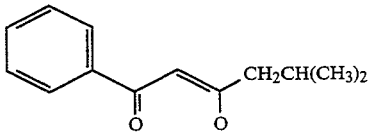 |
| 24 | Zn | 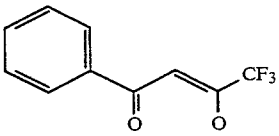 |
| 25 | Cu | 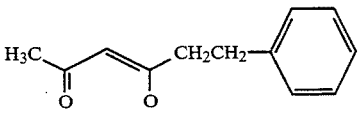 |
| 26 | Cu | 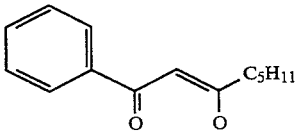 |
| 27 | Ni | 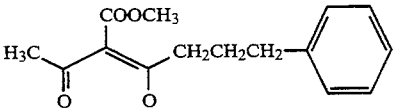 |
| 28 | Ni | 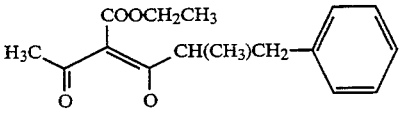 |
| 29 | Ni | 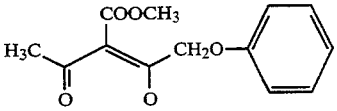 |
-continued
| No | M | X |
|---|---|---|
| 30 | Ni | 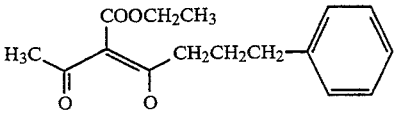 |
| 31 | Ni | 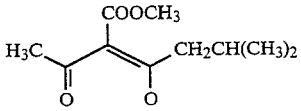 |
| 32 | Ni | 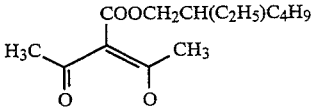 |
| 33 | Ni | 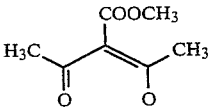 |
| 34 | Ni | 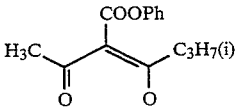 |
| 35 | Ni | 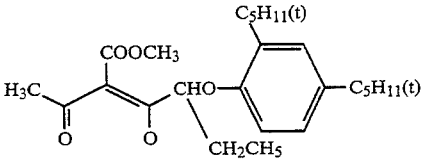 |
| 36 | Ni | 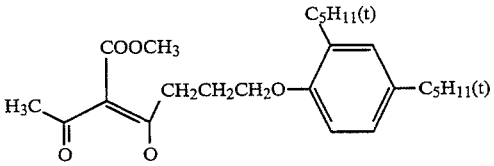 |
| 37 | Ni | 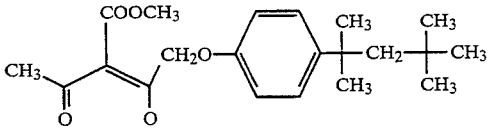 |
| 38 | Ni | 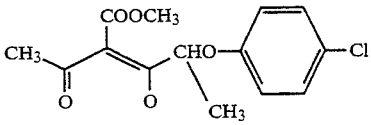 |
| 39 | Ni | 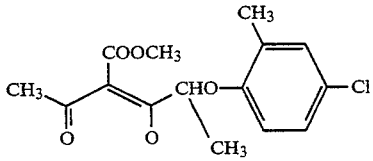 |
| 40 | Ni | 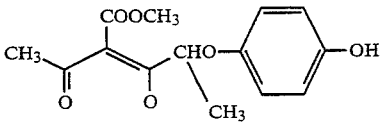 |

-continued

| No | M | X |
|---|---|---|
| 41 | Ni | 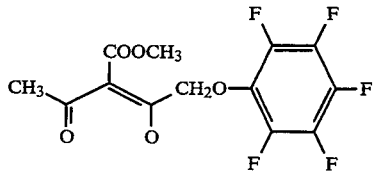 |
| 42 | Ni | 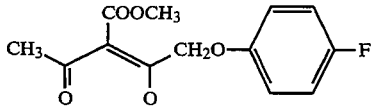 |
| 43 | Ni | 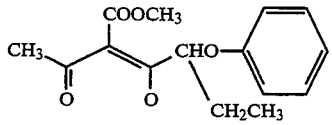 |
| 44 | Ni | 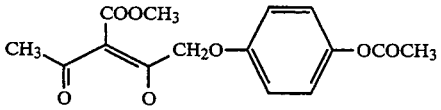 |
| 45 | Ni | 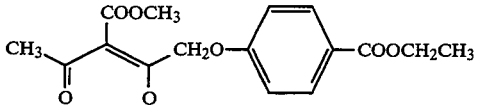 |
| 46 | Ni | 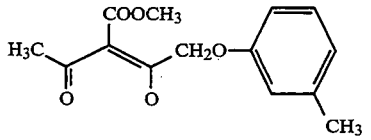 |
| 47 | Ni | 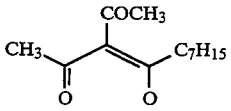 |

The compounds of the foregoing formula can be synthesized according to the methods described, for example, in "Chelate Chemistry (5)-Experiment of Complex Compound Chemistry [I]" edited by Nankodo Publishing Co.

A preferred image recording material of the invention comprises a support and provided thereon an image receiving layer containing at least one binder and the compound of the invention represented by Formula (I) (hereinafter referred to as the image receiving material of the invention).

Binders usable in the image receiving material of the invention are those having ester linkages, urethane linkages, amido linkages, carbon linkages, sulfone linkages or other high polar linkages. Typical examples thereof include polyester resins, polyvinyl chloride resins, copolymer resins of vinyl chloride and other monomer (for example, vinyl acetate), polyacrylonitrile resins, polycaprolactone resins, polyvinyl butyral resins, polyvinyl pyrrolidone resins, styrene-maleic anhydride copolymer resins and polycarbonate resins; these may be used singly or in combination of two or more types or may be copolymers. Among these resins, preferred ones are the plasticizer-containing polycarbonates and polyvinyl acetals disclosed in Japanese Pat. O.P.I. Pub. No. 19138/1985, and especially preferred ones are the polyvinyl butyrals disclosed in Japanese Pat. O.P.I. Pub. No. 11293/1986. These binders are used in amounts of 0.1 to 50 g, and preferably 0.5 to 20 g per square meter of the support.

As a support used in the image receiving material of the invention, either a transparent support or an opaque support can be employed. Suitable examples include films of plastics such as polyethylene terephthalate, polycarbonate, polystyrene, polyvinyl chloride, polyethylene, polypropylene; films of the above plastics containing a pigment such as titanium oxide, barium sulfate, calcium carbonate, talc; baryta paper; paper laminated with a pigment-containing thermoplastic resin; cloths; glass plates; and plates of metals such as aluminium. Further, there can also be used a support obtained by coating and curing a pigment-containing electron-radiation-curing resin composition on the above plastic film as well as a support obtained by providing a pigment-containing coating layer on one of the above supports. Moreover, the cast-coated paper disclosed in Japanese Pat. O.P.I. Pub. No. is also useful as a support.

The image receiving material may be composed of two or more layers for the purpose of improving the fixing property and sensitivity. In such multilayer structure, it is preferred that a layer nearer to the support (hereinafter referred to as the lower layer) be higher in dye receptivity than a layer farther from the support (hereinafter referred to as the upper layer). Further, the stability of transferred images (including non-retransferability, for example) can be enhanced by use of resins different in glass transition points in the lower layer and the outermost layer, or by varying the addition amount of a high boiling solvent or the thermal solvent described in Japanese Pat. O.P.I. Pub. No. 256795/1991. The compound of the invention may be added either to the upper layer or to the lower layer, and its addition to the lower layer is preferred in respect of sensitivity.

The dye receptivity is determined by the following steps:

A coating solution comprising a binder used in the image receiving material and a dye at a ratio of 100:1 is prepared and coated on a support so as to give a dry thickness of 4 μm, followed by drying. The first coloring layer is thus formed. Then, a coating solution comprising a binder other than that used in the first coloring layer and the dye used in the first coloring layer was prepared and coated so as to give a dry thickness of 4 mm, followed by drying to give the second coloring layer. The support bearing the laminated coloring layers is heated to 100° C. for 24 hours and, then, cut into 3 μm thick slices at right angles to the direction of lamination with a microtome. The dye receptivities of the binders can be compared with each other by observing the coloring degrees of the respective cross-sectional layers with a microscope.

In order to form an image using the compound of the invention in the image receiving material, an ink sheet comprising a support having thereon a colorant layer containing at least one dye capable of forming a chelated dye is used. Such a dye can form a chelated dye on reaction with a metal ion; examples thereof include the dyes illustrated in Japanese Pat. O.P.I. Pub. Nos. 114892/1991, 62092/1991, 62094/1991, 82896/1992 and 16545/1993, and in Japanese Pat. Appl. Nos. 107778/1992 and 167793/1992. In the invention, these dyes are contained in amounts of 0.1 to 20 g and preferably 0.2 to 10 g per square meter of the support.

The dyes used in the invention include those represented by the following Formulas (III), (IV) and (V).

The yellow dye includes a compound represented by Formula (III)

Formula (III)

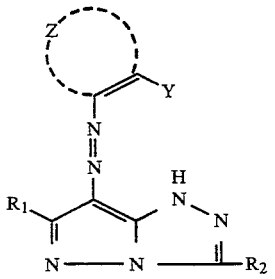

wherein $R_1$ and $R_2$ independently represent a hydrogen atom or a substituent; Y represents $OR_3$, $SR_3$ or $NR_3R_4$ wherein $R_3$ and $R_4$ independently a hydrogen atom, a substituted or unsubstituted alkyl group or a substituted or unsubstituted aryl group; and Z represents an atomic group necessary to form a 5- or 6 membered aromatic ring together with two carbon atoms.

The substituents represented by $R_1$ and $R_2$ in Formula (III) include a halogen atom, a substituted or unsubstituted alkyl group (for example, a methyl, isopropyl, t-butyl, trifluoromethyl, methoxymethyl, 2-methanesulfonylmethyl, 2-methanesulfon-amidoethyl or cyclohexyl group), a substituted or unsubstituted aryl group (for example, a phenyl, 3-methylphenyl, 4-t-butylphenyl, 3-nitrophenyl, 3-acylaminophenyl or 2-methoxyphenyl group), a cyano group, an alkoxy group, an aryloxy group, an acylamino group, an anilino group, an ureido group, a sulfamoylamino group, an alkylthio group, an arylsulfamoyl group, a sulfonyl group, an alkoxycarbonyl group, a heterocyclicoxy group, an acyloxy group, a carbamoyloxy group, a silyloxy group, an aryloxycarbonylamino group, an imido group, a heterocyclicthio group, a phosphonyl group and an acyl group. $R_3$ and $R_4$ in Formula (III) include the same alkyl or aryl group as $R_1$ and $R_2$. The 5- or 6 membered aromatic ring formed together with two carbon atoms and Z includes benzene, pyridine, pyrimidine, triazine, pyrazine, pyridazine, pyrrole, furan, thiophene, pyrazole, imidazole, triazole, oxazole and thiazole. The ring may have a substituent or form a condensed ring together with another aromatic ring.

Typical examples of the yellow dyes are mentioned below but are not limited thereto.

Y-1

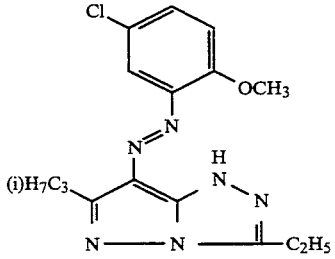

-continued

Y-2

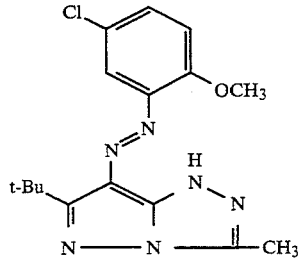

Y-3

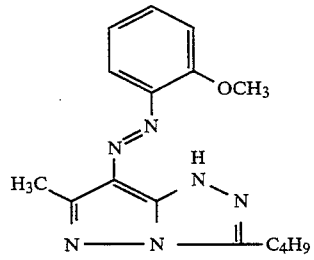

Y-4

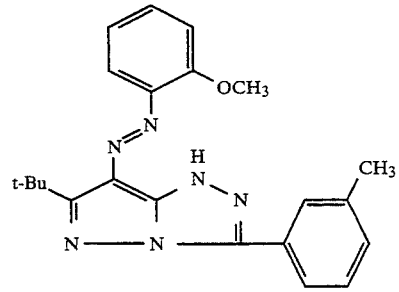

Y-5

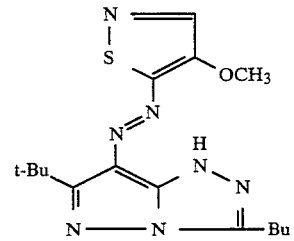

The magenta dye includes a compound represented by Formula (IV) .

Formula (IV)

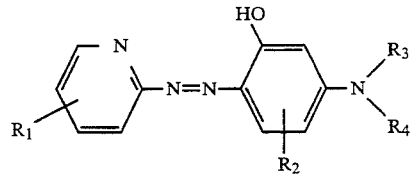

wherein $R_1$ represents an alkyl group, a halogen atom or a hydrogen atom; $R_2$ represents an alkyl group or a hydrogen atom; $R_3$ and $R_4$ independently represent a substituted or unsubstituted alkyl group, a substituted or unsubstituted aralkyl group or a substituted or unsubstituted aryl group, provided that at least one of $R_3$ and $R_4$ represents an aryl group having an alkyl group or an aralkyl group having an alkyl group.

$R_1$ in Formula (IV) includes a methyl, ethyl or butyl group, a chlorine atom or a bromine atom. $R_2$ in Formula (IV) includes a methyl group. $R_3$ and $R_4$ in Formula (IV) independently represent a methyl, ethyl, propyl, i-propyl, butyl, i-butyl, pentyl, hexyl, ethoxycarbonylmethyl or methoxyethyl group, a phenyl or m-tolyl group, provided that at least one of $R_3$ and $R_4$ represents a m-tolyl group, a p-tolyl group or a methylbenzyl group.

Typical examples of the magenta dyes are mentioned below, but are not limited thereto.

M-1

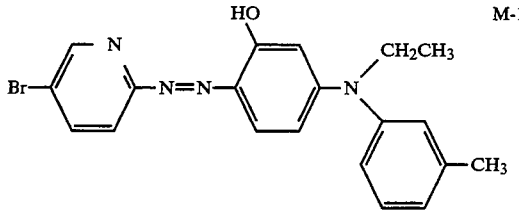

M-2

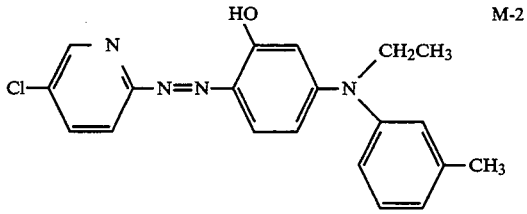

M-3

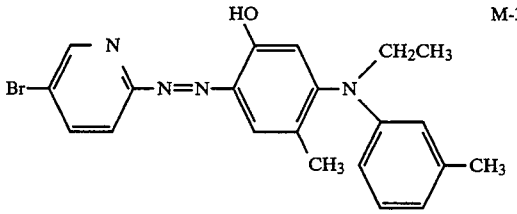

M-4

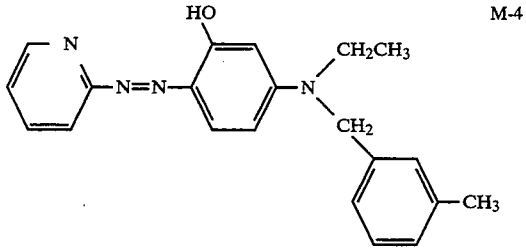

M-5

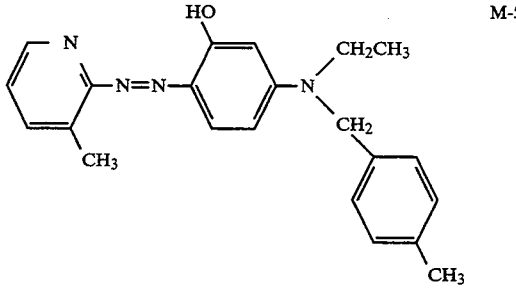

The cyan dye includes a compound represented by Formula (V).

Formula (V)

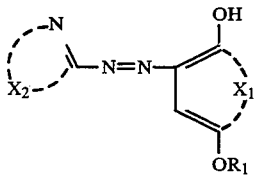

wherein $R_1$ represents a substituted or unsubstituted alkyl group; $X_1$ represents an atomic group necessary to form a substituted or unsubstituted aromatic ring; and $X_2$ represents an atomic group necessary to form a substituted or unsubstituted azole, thiazole, benzothiazole or pyridine ring.

$R_1$ in Formula (V) preferably represents an alkyl group having 1 to 12 carbon atoms (for example, a methyl, ethyl, n-propyl, n-hexyl, n-decyl, i-propyl or 2-ethylhexyl group). The alkyl group may have as a substituent an alkoxy group (for example, a methoxy or ethoxy group), a halogen atom, a carboxyl group or an aryl group (for example, a phenyl group). $X_1$ in Formula (V) preferably represents an atomic group necessary to form a benzene or naphthalene ring. $X_2$ in Formula (V) preferably represents a thiazole or benzothiazole ring.

Typical examples of the cyan dyes are mentioned below, but are not limited thereto.

C-1

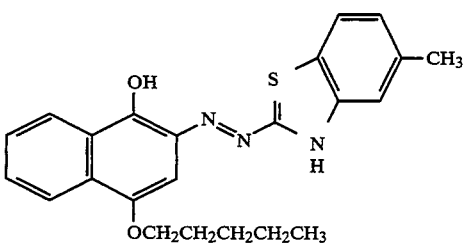

C-2

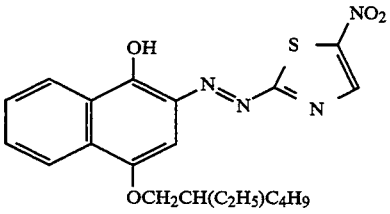

C-3

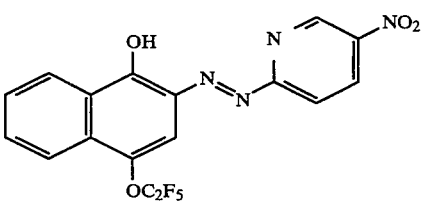

C-4

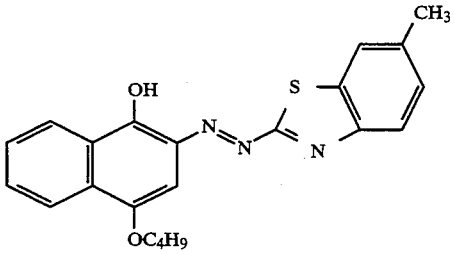

C-5

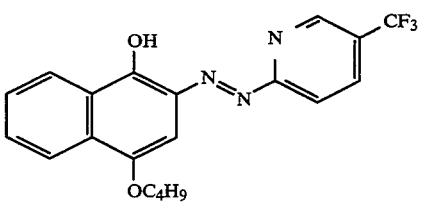

The binder used in the ink sheet includes water-soluble polymers of cellulose-type, polyacrylic acid-type, polyvinyl alcohol-type, polyvinylpyrrolidone-type; and organic solvent-soluble polymers such as acrylic resins, metacrylic resins, polystyrenes, polycarbonates, polysulfones, polyether sulfones, polyvinyl butyrals, polyvinyl acetals, ethyl cellulose, nitrocellulose. In the case of organic solvent-soluble polymers, these may be used as an organic solvent solution containing one or more of them, as well as in the form of a latex.

Preferably, these binders are used in amounts of 0.1 to 50 g per square meter of support.

In another preferred embodiment of the invention, the image recording material has, on a support, a colorant layer containing at least one dye capable of forming a chelated dye and a layer containing the binder and the compound of the invention (this image recording material comprising the colorant layer and the layer containing the compound of the invention is hereinafter referred to as the image transfer material of the invention). In the image transfer material of the invention, a colorant layer and a layer containing the compound of the invention may be provided in layers on a support as described in Japanese Pat. O.P.I. Pub. No. 81195/1991, or these may be alternately provided on a support, on the same plane with each other, as described in Japanese Pat. O.P.I. Pub. No. 329191/1992. The colorant layer used in the image transfer material of the invention can be formed by coating a coating solution prepared by dissolving or dispersing the dye and a binder in a solvent on a support, followed by drying.

The dye, binder and support used in the image transfer material of the invention may be the same as those employed in the foregoing ink sheet.

The layer containing the compound of the invention used in the image transfer material of the invention (hereinafter referred to as the image transfer layer of the invention) further comprises a heat-fusible compound. The heat-fusible compound employed in the image transfer layer of the invention is preferably a colorless or white compound having a melting point within the range of 65° to 130° C.; examples thereof include waxes such as carnauba wax, beeswax, candelilla wax; higher fatty acids such as stearic acid, behenic acid; alcohols such as xylitol; amides such as acetamide, benzamide; and ureas such as phenylurea, diethylurea. In addition to the above components, the image transfer layer preferably contain a polymer, such as polyvinylpyrrolidone, polyvinyl butyral or unsaturated polyester, for the enhancement of dye retention.

The image transfer layer can be formed by coating a coating solution prepared by dissolving or dispersing the compound of the invention, a binder and a heat-fusible compound in a solvent on a support and drying.

Any type of support may be used as long as it has a high dimensional stability and resists the heat applied during recording with a thermal head. Preferred examples include tissue paper such as condenser paper and glassine paper; and films of heat-resistant plastics such as polyethylene terephthalate, polyethylene naphthalate, polyamide and polycarbonate. The thickness of the support is preferably in the range of 2 to 30 μm. Further, there may be provided a subbing layer on the support for the purposes of improving the adhesion to the binder and preventing transfer or migration of the dye to the support.

The colorant layer and the layer containing the compound of the invention are provided on a support by coating or printing a printing method such as gravure printing. The thickness of each of the layers is in the range of 0.1 to 20 μm, and preferably 0.2 to 10 μm in dry coating thickness.

In order to accelerate the transfer of the layer containing the compound of the invention, the image transfer material of the invention further comprises an intermediate layer between the layer containing the compound of the invention and the support. Preferably, this intermediate layer comprises a resin composition containing the binder used in the colorant layer and a releasing agent, or a resin of high release property such as a silicone resin or a fluororesin. Suitable releasing agents include the silicone oils, phosphate-type surfactants and fluorine-containing surfactants illustrated in Japanese Pat. O.P.I. Pub. No. 135793/1992.

Preferred embodiments of the image forming method of the invention are hereunder described.

In one image forming method according to the invention, chelated dye images are formed on an image receiving material by reacting a dye capable of forming a chelated dye with the compound of the invention, through the steps of superposing the image receiving material containing the compound of the invention on an ink sheet containing the dye, and heating imagewise them to transfer the dye in the ink sheet to the image receiving material.

In another image forming method according to the invention, chelated dye images are formed on an image receiving material (including plain paper having no image receiving layer) using an image transfer material comprising a thermal transfer layer containing both the compound of the invention and a dye capable of forming a chelated dye, by a method comprising superposing the thermal transfer layer of the image transfer material on the image receiving material, material to transfer the thermal transfer layer to the image receiving material and heating imagewise the transferred image transfer layer, or by a method comprising superposing the image transfer layer on the image receiving material, and transferring both the compound of the invention and the dye to the image receiving material by heating imagewise the image transfer layer. Heating is usually carried out by use of a thermal head, but there may also be used the electric heating method disclosed in Japanese Pat. O.P.I. Pub. No. 123695/1984 or the laser heating method by use of a light-heat converting element which is disclosed in European Pat. No. 454,083.

After the image formation, the image receiving material may be further heated. Since this heating needs no imagewise heating, hot stamping and radiation heating (for example, use of a xenon lamp) can also be used besides the foregoing heating methods.

EXAMPLES

The invention is hereunder described with examples, but the embodiment of the invention is by no means limited to these examples.

Example 1

Coating solutions for image receiving layers were prepared using the following compositions. Types of the compound of the invention contained in these compositions are shown in Table 1. Parts is by weight.

| | |
|---|---|
| Polyvinyl butyral resin (Eslec BX-1 made by Sekisui Chem. Co.) | 5.0 parts |
| Metal ion providing compound (see Table 1) | 5.0 parts |
| Methyl ethyl ketone | 72.0 parts |

-continued

| | |
|---|---|
| Cyclohexanone | 18.0 parts |

Each of these coating solutions was made a uniform solution by heating and allowed to stand till it was brought to room temperature and, then, its stability was checked. Subsequently, each coating solution was coated on a paper support laminated with polyethylene on both sides with a wire bar and dried so as to give a dry coating thickness of 3 μm and form an image receiving layer. Thus, an image receiving material was prepared. The background whiteness of each image receiving material was measured with an X-rite 310TR densitometer, of which results are shown in Table 1.

It is understood from the table that the compounds of the invention are high in solubility and free from deposition and the image receiving materials using the compounds of the invention are excellent in whiteness.

TABLE 1

| Sample No. | Metal Ion Providing Compound | Solubility | Deposition | Whiteness | Dmax | Reactivity |
|---|---|---|---|---|---|---|
| 1 | Exemplified Comp. 1 | A | A | A | 2.02 | A |
| 2 | Exemplified Comp. 4 | B | A | A | 1.96 | A |
| 3 | Exemplified Comp. 7 | B | A | A | 2.10 | A |
| 4 | Exemplified Comp. 13 | B | A | A | 2.13 | A |
| 5 | Exemplified Comp. 24 | A | A | A | 1.95 | A |
| 6 | Exemplified Comp. 26 | B | A | A | 1.91 | A |
| 7 | Exemplified Comp. 27 | B | A | A | 2.20 | A |
| 8 | Exemplified Comp. 35 | A | A | A | 2.18 | A |
| 9 | Exemplified Comp. 38 | A | A | A | 2.20 | A |
| 10 | Exemplified Comp. 45 | A | A | A | 2.25 | A |
| 11 | Comparative Comp. 1 | D | B | B | 1.65 | A |
| 12 | Comparative Comp. 2 | D | B | B | 1.70 | B |
| 13 | Comparative Comp. 3 | C | B | C | 1.57 | B |

(Note)
Comparative Comp. 1 $Ni(acac)_2$ acac: $CH_3COCH_2COCH_3$
Comparative Comp. 2 $Ni(C_{17}H_{35}COO)_2$
Comparative Comp. 3 $Co(CH_3COCH_2COC_5H_{11})_2$ The alphabetical letters in Table 1 have the following meanings:

Solubility
- A: Coating composition dissolves on stirring at room temperature.
- B: Coating composition dissolves on heating.
- C: Deposition (deposits dissolve when the solvents are doubled in volume.)
- D: Deposition (deposits do not dissolve even when the solvents are doubled in volume.)

Deposition
- A: No deposits are observed.
- B: Deposits are observed.

Whiteness (Whiteness of the image receiving layer was visually observed.)
- A: Good
- B: Satisfactory
- C: Poor Reactivity (Sample carrying a transferred image was held for 1 minute in an oven kept at 100° C. and then visually observed for change in color tone due to heating)
- A: Good
- B: Satisfactory
- C: Poor

Example 2

An ink containing a heat diffusible dye used in the invention was prepared in the form of a uniform solution by use of the following composition.

| | |
|---|---|
| Magenta dye M-1 | 10 g |
| Nitrocellulose resin | 20 g |
| Methyl ethyl ketone | 400 ml |

Preparation of Dye Providing Material

This ink was coated with a wire bar and dried so as to give a dry coating weight of 1.0 g/m$^2$ on a 4.5-μm thick polyethylene terephthalate film support and form a layer containing a heat diffusible dye. Dye providing material No. 1 of the invention was thus obtained. Incidentally, a nitrocellulose layer containing a silicone-modified urethane resin (SP-2105 made by Dainichi Seika Co.) was provided as an antisticking layer on the reverse side of the polyethylene terephthalate film support.

The resultant dye providing material was superposed on each of the image receiving materials prepared in Example I so as to bring the ink layer into contact with the image receiving layer. Then, image recording was carried out under the following conditions by applying a thermal head to the reverse side of the dye providing material. The maximum reflection density (Dmax) and the chelating reactivity of the dye were evaluated on each sample. The results are shown in Table 1. As is apparent from Table 1, the image receiving materials each containing the compound of the invention gave favorable results, showing high maximum reflection densities and exhibiting high chelating reactivities irrespective of the energy applied.

Recording Conditions
- Line density in primary scanning: 8 dot/mm
- Line density in secondary scanning: 8 dot/mm
- Recording power: 0.6 W/dot
- Heating time with thermal head: heating time was adjusted gradually within the range of 20 msec to 2 msec.

Example 3

Preparation of Image Transfer Material Containing Metal Ion Providing Compound On a 4.5-μm thick polyethylene terephthalate film support was coated, with a wire bar, a methyl ethyl ketone dispersion of exemplified compound No. 26 of the invention (coating weight: 3.0 g/m$_2$), UV absorbent UV-1 described later (coating weight: 0.2 g/m$_2$), antioxidant AO-1 described later (coating weight: 0.2 g/m$^2$), ethylene-vinyl acetate copolymer (vinyl acetate content: 20%, coating weight: 0.5 g/m$^2$) and paraffin wax (coating weight: 2.5 g/m$_2$), followed by drying to form an image transfer layer. A nitrocellulose layer containing a silicone-modified urethane resin (SP-2105 made by Dainichi Seika Co.) was provided as an antisticking layer on the reverse side of the polyethylene terephthalate film support.

Transferring Image Recording

The foregoing image transfer material containing the compound of the invention was superposed on wood free paper, and heating was carried out under the following conditions by applying a thermal head to the reverse side of the image transfer material to transfer the image transfer layer. The support was peeled from the superposed material to obtain an image receiving material.

Transferring Conditions

Line density in primary scanning and secondary scanning: 8 dot/mm

Recording power: 0.6 W/dot

Heating time: 3 msec

Subsequently, this image receiving material was superposed on a dye providing material, which was prepared in the same way as in Example 2, except that a polyvinyl butyral resin was used in place of the nitrocellulose resin, and the dry coating weight was changed to 0.8 g/m$^2$. Then, heating was carried out under the following conditions by applying imagewise thermal head to the reverse side of the dye providing material and the support of the dye providing material was peeled. The magenta image thus obtained had an excellent gradation.

Recording Conditions

Linear density in primary scanning and secondary scanning: 8 dot/mm

Recording power: 0.6 W/dot

Heating time: heating time was adjusted gradually within the range of 20 msec to 2 msec.

The color tone of the resulting image did not change on heating, which exhibited a high reactivity.

Example 4

Dye providing material No. 2 was prepared in the same manner as in Example 2, except that yellow dye Y-1 was used in place of magenta dye M-1. Dye providing material No. 3 was prepared in the same manner as in Example 2, except that cyan dye C-1 was used in place of magenta dye M-1. These two and Dye providing material No. 1 prepared in Example 2 were superposed on the image receiving material (sample No. 6) prepared in Example 1 and subjected to heating imagewise by applying a thermal head to the reverse side of each dye providing material. The resulting full color image was less in staining in the white backgrounds, free from deposition of the compound of the invention and, thereby, had good surface conditions.

UV-1

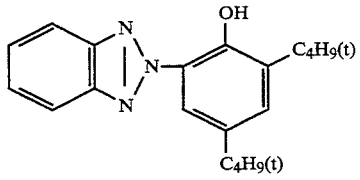

AO-1

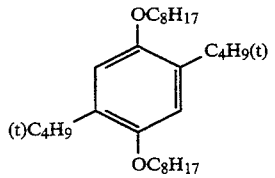

What is claimed is:

1. A thermal transfer recording material comprising a support and provided thereon, a layer containing a binder and a metal ion providing compound represented by the following Formula (I)

$$M^{2+}(X^-)_2 \qquad \text{Formula (I)}$$

wherein $M^{2+}$ represents a divalent transition metal ion; and X represents a ligand capable of combining with the metal ion to form a complex, said ligand being represented by the following Formula (II);

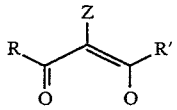

Formula (II)

wherein Z represents an alkyl group, an aryl group, an aryloxycarbonyl group, an alkoxycarbonyl group, an acyl group, a halogen atom, or a hydrogen atom; and R and R' independently represent an alkyl group or an aryl group, provided that when Z represents a hydrogen atom, R and R' are not simultaneously methyl groups, or at least one of R and R' may combine with Z to form a ring.

2. The material of claim 1, wherein said divalent transition metal is a nickel or zinc ion.

3. The material of claim 1, wherein said Z in Formula (II) represents an aryloxycarbonyl group or an alkoxycarbonyl group.

4. The material of claim 1, wherein said metal ion providing compound is contained in an amount of 0.5 to 20 g per m$^2$ of the support.

5. The material of claim 1, wherein said binder is contained in an amount of 0.1 to 50 g per m$^2$ of the support.

6. The material of claim 1, wherein said binder is a polyvinyl butyral.

7. The material of claim 1 further comprising an ink layer adjacent said layer containing said binder and said metal-ion providing compound, said ink layer containing a heat diffusible dye capable of forming a chelated dye on reaction with said metal ion providing compound.

8. A thermal transfer image forming method comprising the steps of:

(a) superposing an image receiving layer of an image receiving material upon an ink sheet comprising a support having thereon an ink layer containing a heat diffusible dye capable of forming a chelated dye, said image receiving layer coming into contact with the ink layer and said image receiving layer containing a binder and a metal ion providing compound;

(b) applying imagewise heat to the superposed material to transfer the dye in the ink layer to the image receiving layer and forming a chelated dye image by reaction of said metal ion providing compound with said heat diffusible dye on the image receiving layer; and (c) peeling apart the ink sheet from the superposed material;

wherein said metal ion providing compound is represented by the following Formula (I):

$$M^{2+}(X^-)_2 \qquad \text{(Formula (I)}$$

wherein $M^{2+}$ represents a divalent transition metal ion; and X represents a ligand capable of combining with the metal ion to form a complex, said ligand being represented by the following Formula (II):

Formula (II)

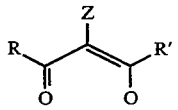

wherein Z represents an alkyl group, an aryl group, an aryloxycarbonyl group, an alkoxycarbonyl group, an acyl group, a halogen atom, or a hydrogen atom; and R and R′ independently represent an alkyl group or an aryl group, provided that when Z represents a hydrogen atom, R and R′ are not simultaneously methyl groups, or at least one of R and R′ may combine with Z to form a ring.

* * * * *